US010822949B1

(12) United States Patent
Bai et al.

(10) Patent No.: US 10,822,949 B1
(45) Date of Patent: Nov. 3, 2020

(54) APPARATUS FOR PROTECTING ROOF TRAY WHEN GOB-SIDE ENTRY RETAINING END SUPPORT MIGRATES

(71) Applicants: CHINA UNIVERSITY OF MINING AND TECHNOLOGY, Xuzhou (CN); CHINA MINING & CIVIL NEW MATERIAL SCIENCE AND TECHNOLOGY LTD., Yangzhou (CN)

(72) Inventors: Jianbiao Bai, Xuzhou (CN); Rui Wang, Xuzhou (CN); Shuai Yan, Xuzhou (CN); Junwu Xia, Xuzhou (CN); Xiangyu Wang, Xuzhou (CN); Ying Xu, Xuzhou (CN); Gongyuan Wang, Xuzhou (CN); Ningkang Meng, Xuzhou (CN); Zaizhuang Fan, Xuzhou (CN)

(73) Assignees: CHINA UNIVERSITY OF MINING AND TECHNOLOGY, Xuzhou (CN); CHINA MINING & CIVIL NEW MATERIAL SCIENCE AND TECHNOLOGY LTD., Yangzhou (CN)

( * ) Notice: Subject to any disclaimer, the term of this patent is extended or adjusted under 35 U.S.C. 154(b) by 0 days.

(21) Appl. No.: 16/961,256

(22) PCT Filed: Sep. 17, 2019

(86) PCT No.: PCT/CN2019/106101

§ 371 (c)(1),
(2) Date: Jul. 10, 2020

(87) PCT Pub. No.: WO2020/186710

PCT Pub. Date: Sep. 24, 2020

(30) Foreign Application Priority Data

Mar. 18, 2019 (CN) ..... 2019 1 0201871

(51) Int. Cl.
*E21D 23/08* (2006.01)
*E21D 23/04* (2006.01)

(52) U.S. Cl.
CPC ..... *E21D 23/086* (2013.01); *E21D 23/0418* (2013.01)

(58) Field of Classification Search
CPC ..... E21D 23/03; E21D 23/085; E21D 23/086; E21D 23/0418
See application file for complete search history.

(56) References Cited

U.S. PATENT DOCUMENTS 4,026,118 A * 5/1977 McCay, Jr. ..... B62D 33/06 405/291
4,089,181 A * 5/1978 Koppers ..... E21D 23/0043 299/11

(Continued)

FOREIGN PATENT DOCUMENTS

CN 101096911 A 1/2008
CN 105715289 A 6/2016

(Continued)

*Primary Examiner* — Benjamin F Fiorello
(74) *Attorney, Agent, or Firm* — Bayramoglu Law Offices LLC

(57) ABSTRACT

An apparatus for protecting a roof tray when a gob-side entry retaining end support migrates is provided. The apparatus is mounted at a top end position of a hydraulic support, and includes a movable bearing mechanism, an automatic expansion/contraction connecting groove mechanism, and an active reset mechanism. The movable bearing mechanism includes two parallel belts and a plurality of rollers supporting the belts, and the rollers are mounted on and supported by a bearing mechanism. The automatic expansion/contraction connecting groove mechanism is two concave base plates fixed between the two belts, and the two concave base plates are spaced by a distance. The active reset mechanism includes two telescopic rods and reset springs sleeved on the (Continued)

telescopic rods, and the telescopic rod is connected to an end portion of the reset spring to form a synchronous mechanism.

12 Claims, 6 Drawing Sheets

(56) References Cited

U.S. PATENT DOCUMENTS 4,195,953 A * 4/1980 Becker ..... E21D 23/0034 405/300
4,266,891 A * 5/1981 Plevak ..... E21D 23/0034 403/318
4,347,021 A * 8/1982 Elsner ..... E21D 23/066 405/291
4,386,878 A * 6/1983 Martinko ..... E21D 23/0034 405/291
4,430,026 A * 2/1984 Hill ..... E21D 23/063 299/33
4,600,340 A * 7/1986 Rosenberg ..... E21D 23/04 405/297
4,629,368 A * 12/1986 Hill ..... E21D 23/0427 405/296
4,708,531 A * 11/1987 Plenter ..... E21D 23/04 405/296
4,815,898 A * 3/1989 Wojaczek ..... E21D 23/0039 405/291
4,828,433 A * 5/1989 Wojaczek ..... E21D 23/0427 403/150
4,887,935 A * 12/1989 Koppers ..... E21C 41/16 405/302
4,940,363 A * 7/1990 Brown ..... E21D 23/0436 405/296
5,073,067 A * 12/1991 Elliott-Moore ..... E21D 23/16 405/302
5,454,669 A * 10/1995 Oziem ..... E21D 15/512 405/291
2004/0258487 A1* 12/2004 Suilmann ..... E21D 23/16 405/294
2011/0163590 A1* 7/2011 Mozar ..... E21C 41/16 299/43
2011/0248548 A1* 10/2011 Junker ..... E21C 35/24 299/1.6

FOREIGN PATENT DOCUMENTS

| | | | |
|---|---|---|---|
| CN | 205330704 | U | 6/2016 |
| CN | 105736027 | A | 7/2016 |
| CN | 206233939 | U | 6/2017 |
| CN | 207048801 | U | 2/2018 |
| CN | 109838265 | A | 6/2019 |
| DE | 3021548 | A1 | 3/1982 |

* cited by examiner

APPARATUS FOR PROTECTING ROOF TRAY WHEN GOB-SIDE ENTRY RETAINING END SUPPORT MIGRATES

CROSS REFERENCE TO THE RELATED APPLICATIONS

This application is the national phase entry of International Application No. PCT/CN2019/106101, filed on Sep. 17, 2019, which is based upon and claims priority to Chinese Patent Application No. 201910201871.2, filed on Mar. 18, 2019, the entire contents of which are incorporated herein by reference.

TECHNICAL FIELD

The present invention relates to a hydraulic support auxiliary apparatus, and in particular, to an apparatus for protecting a roof tray when a gob-side entry retaining end support migrates, and belongs to the field of underground support devices.

BACKGROUND

After a working face is mined, a specific technical means is adopted to recover protective coal pillars left in a conventional mining mode, and a gate road of a previous section is shored again for use by a next section. Such a method of retaining an entry at an original gate road position along an edge of a gob is referred to as gob-side entry retaining. During the gob-side entry retaining, a constructed roadside filling body is directly related to advancement of a coal mining face, and a proper space between the roadside filling body and the coal mining face is generally controlled through a mechanical structure of an overlying roof of the roadside filling body.

However, according to an actual construction situation on site, during advancement of a working face, a hydraulic support that produces a supporting effect needs to advance to further support a roof of a mined part of the working face. However, because a top portion of a roadway is reinforced and shored when the roadway is initially excavated, where a typical shoring mode is shoring with an anchor rob or an anchor cable, such a roadway roof shoring form may expose some anchor robs or rob structures of anchor cables of a tray and the tray. During advancement of a hydraulic support of an end, a top portion of the hydraulic support is extremely likely to mesh with the tray and some anchor rod/anchor cable structures that are exposed. Consequently, the tray and some anchor rod/anchor cable structures that are exposed are damaged, resulting in a shoring failure, further a failure of all anchor rod or anchor cable structures, even large deformation of a roadway roof, and a threat to production safety of the working face.

Previously, a method for preventing an anchor rod or an anchor cable from being damaged by an end support in actual on-site gob-side entry retaining construction of a coal mine is placing a sleeper with a specific size between an end support and a roof, to prevent the end support from damaging a tray and some anchor rod/anchor cable structures that are exposed. However, because compression strength of the sleeper is relatively small, the sleeper cannot function for a long time, and is likely to fail. In addition, because a contact area between the sleeper and the roof is too small, contact bearing between the end support and the roadway roof is unbalanced. Consequently, the roof partially sinks, and a supporting effect of the anchor rod is further damaged.

SUMMARY

To overcome various disadvantages existing in the prior art, the present invention provides an apparatus for protecting a roof tray when a gob-side entry retaining end support migrates, where the apparatus can protect a tray and some anchor rod/anchor cable structures that are exposed in a support moving process of a support while balancing stress on a roof in the moving process, and can be automatically reset when the support contracts.

To achieve the foregoing objectives of the present invention, the present invention provides an apparatus for protecting a roof tray when a gob-side entry retaining end support migrates, where the apparatus is mounted at a top end position of a hydraulic support, and includes a movable bearing mechanism, an automatic expansion/contraction connecting groove mechanism, and an active reset mechanism. The movable bearing mechanism includes two parallel equal-length conveying belts and several matched rollers supporting the belts, and the rollers are mounted on and supported by a bearing mechanism. The automatic expansion/contraction connecting groove mechanism is two concave base plates fixed between the two belts, and the two concave base plates are oppositely disposed and spaced by a distance. The active reset mechanism includes two telescopic rods and reset springs sleeved on the telescopic rods, the telescopic rod is connected to an end portion of the reset spring to form a synchronous mechanism, and the two both have one end connected to one side of the concave base plate and the other end fixed at the end position of the hydraulic support through a fixed support.

After the hydraulic support is lifted, a tray and some anchor cables or anchor rods that are exposed are embedded between the two concave base plates of the groove mechanism to form a gap, and an upper portion of the belt is attached to the roof through a movable bearing mechanism. As the hydraulic support advances, the belt drives, under backward friction of the roof and forward friction of the end support, the roller to rotate, and the movable bearing mechanism drives the groove mechanism to move backwards relative to the hydraulic support at the same time, and stretches the reset spring in the active reset mechanism. When the hydraulic support is relieved and contracts, and a top beam is lowered, friction between the movable bearing mechanism and the roof is eliminated, and the reset spring in the active reset mechanism pulls the movable bearing mechanism and the groove mechanism to return under the action of resilience.

Further, the two concave base plates are connected through several telescopic springs, and the telescopic springs are all anchored on the concave base plates on two sides through an anchor member.

Because the anchor rods or the anchor cables designed during early-stage reinforced shoring of the roadway are not all arranged according to a uniform standard, the tray and some anchor rob/anchor cable structures that are exposed are misaligned. The springs between the concave base plates can make the tray and some anchor robs/anchor cables that are exposed and that are misaligned accommodated in a protection scope, and a use scope of a protection mechanism is enlarged. Due to addition of the mechanism, the tray and some anchor rob/anchor cable structures that are exposed and that are misaligned can all be included in the protection scope, thereby providing an elastic telescopic buffer range for functioning of the whole apparatus.

An implementation of an automatic expansion/contraction function is introduced as follows: When positions between the two concave base plates, namely, the tray and some anchor rod (cable) structures that are exposed are misaligned, two sides of the base plate of the groove mechanism capable of expanding/contracting for connection tend to expand under a squeezing force from the tray and some anchor rod (cable) structures that are exposed. In this case, the telescopic spring of the groove mechanism capable of expanding/contracting for connection is stretched by a pulling force, the concave base plate of the groove mechanism capable of expanding/contracting for connection is expanded, and the groove mechanism capable of expanding/contracting for connection expands to release pressure, and a spherical hinge mechanism of the automatic reset mechanism moves outwards to meet an expansion effect of groove mechanism capable of expanding/contracting for connection. When an outer side of the movable bearing mechanism is pressed inwards by the tray and some anchor rod (cable) structures that are exposed, the telescopic spring of the groove mechanism capable of expanding/contracting for connection contracts under pressure, the concave base plate of the groove mechanism capable of expanding/contracting for connection is contracted, and the groove mechanism capable of expanding/contracting for connection contracts to release pressure.

To ensure flexibility during expansion of the springs between the concave base plates, the telescopic rod is connected in a hinged manner to the fixed support through an end hinge ball.

To increase friction between the belt and the roller, one surface of the belt in contact with the roller is provided with meshing teeth, and the roller is a meshing roller matching the meshing teeth on the belt.

The telescopic rod is a damping telescopic rod, and when being reset, the damping telescopic rod may counteract a forward inertia force of the movable bearing mechanism and the groove mechanism and a contraction force of some springs, so that the apparatus can be reset better.

Further, if an expansion amount of the telescopic spring is defined as k, a length of the telescopic spring in an initial state is a, a width of each concave base plate is b, a width of each belt is c, and a total width of the support is L, $k+a+2b+2c=L$. If a maximum offset between anchor rods or anchor cables of each row is defined as M, $M=k$.

The present invention enables, by disposing the movable bearing mechanism on the upper end of the hydraulic support, the end support and the roof to actively bear pressure and move relatively in a relative movement process. The groove mechanism that is connected to the middle of a movable bearing structure and that can automatically expand and contract is used for embedding the tray and some anchor rods/anchor cables that are exposed into the structure, so that the tray and some anchor rods/anchor cables that are exposed are effectively protected during an advancement process of the hydraulic support. The springs disposed between the two concave base plates may enable all the anchor rods/anchor cables that are misaligned to be included in a protection scope, and provide elastic telescopic buffering for the whole apparatus. The active reset mechanism may enable the movable bearing mechanism and the groove mechanism to relatively move backwards during an advancement process of the hydraulic support, and in addition, can enable the movable bearing mechanism and the groove mechanism to return to original positions relative to the active reset mechanism under the action of resilience when the top beam is lowered. Advantages of the present invention are that the tray and some anchor rods/anchor cables that are exposed can all be protected in a support moving process of the hydraulic support, and in addition, high compression strength can balance stress on the roof, to prevent a failure of a roadway shoring device in the support moving process of the hydraulic support from resulting in roof separation and a roadway retaining failure.

In the figures: 1. fixed support; 2. reset spring; 3. telescopic rod; 4. belt; 5. roller; 6. anchor member; 7. telescopic spring; 8. concave base plate; 9. end hinge ball; and 10. bearing mechanism.

DETAILED DESCRIPTION

The following describes the present invention in detail with reference to the accompanying drawings and specific embodiments.

Figure 1:
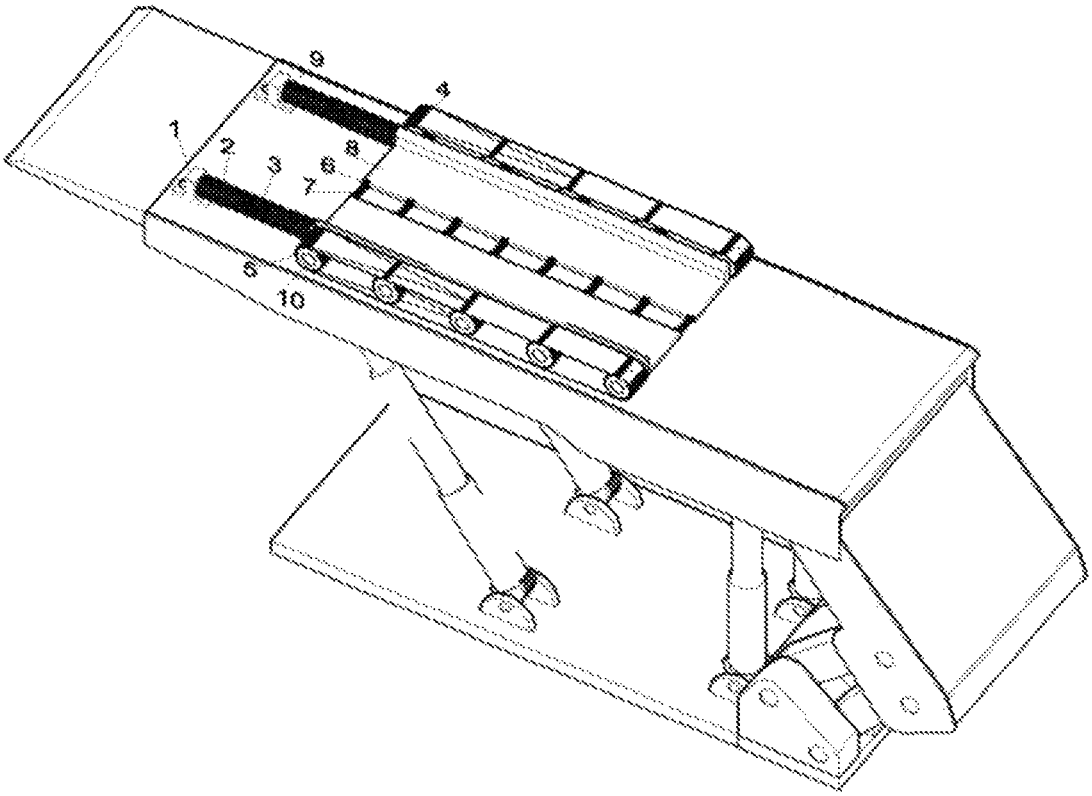
FIG. 1 is a schematic three-dimensional structural diagram of an apparatus of the present invention mounted on a hydraulic support.
Figure 2:
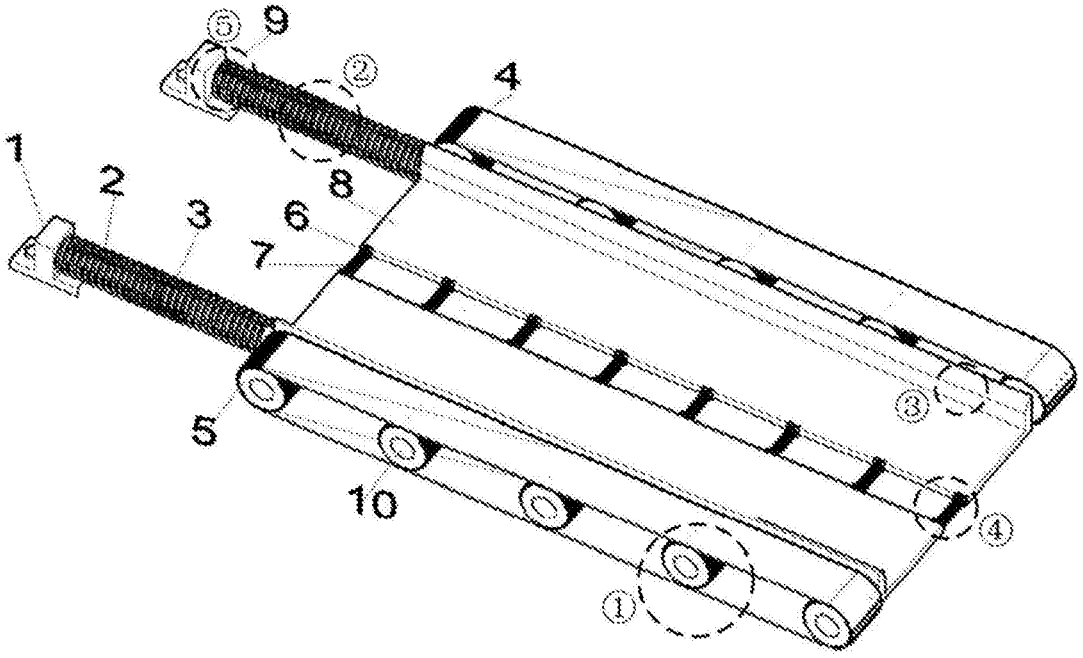
FIG. 2 is a schematic three-dimensional structural diagram of the present invention.
Figure 3:
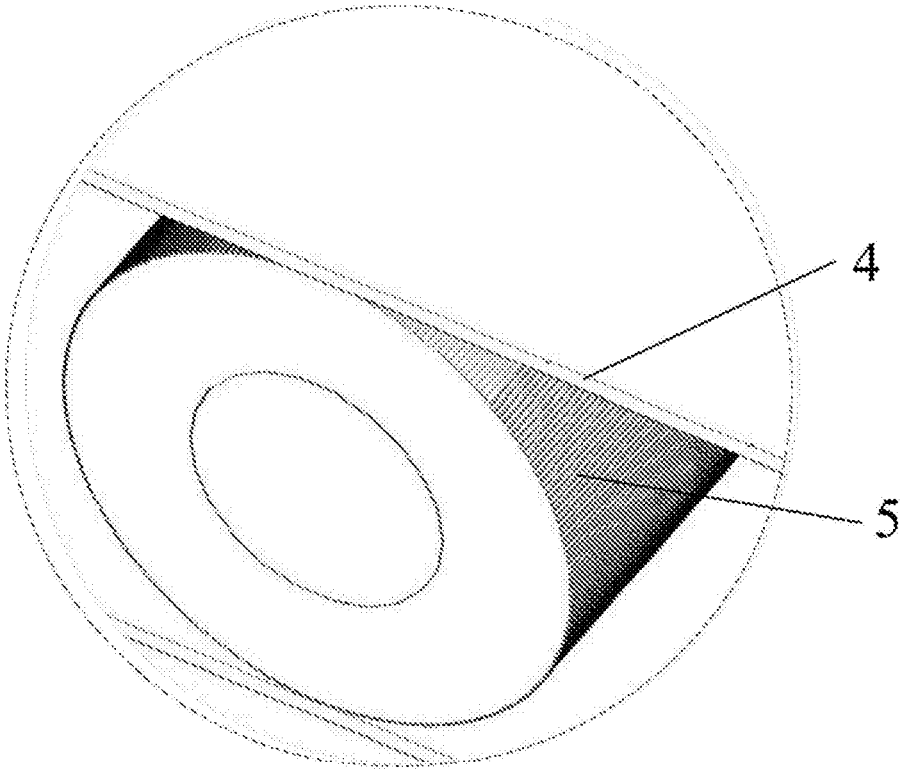
FIG. 3 is a schematic partial enlarged diagram of a movable bearing mechanism at ① in FIG. 2.
Figure 4:
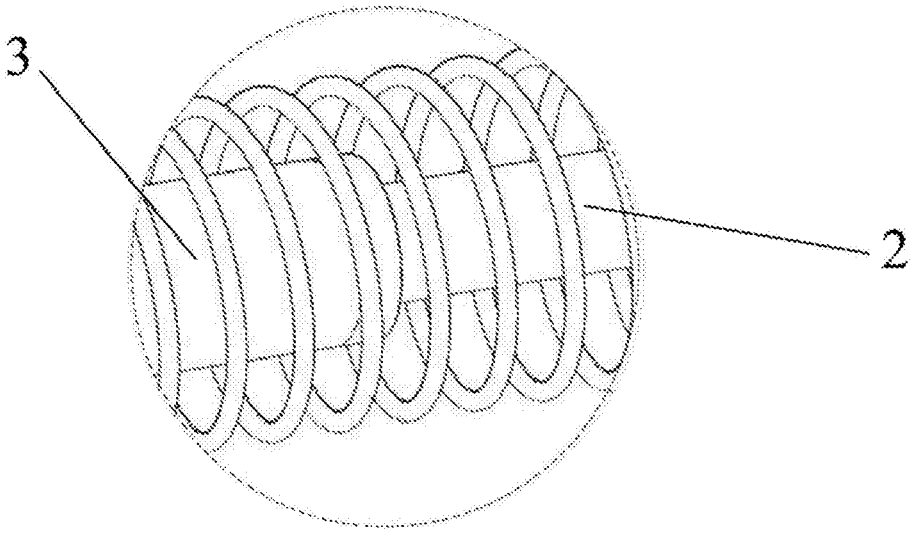
FIG. 4 is a schematic partial enlarged diagram of an active reset mechanism at ② in FIG. 2.
Figure 5:
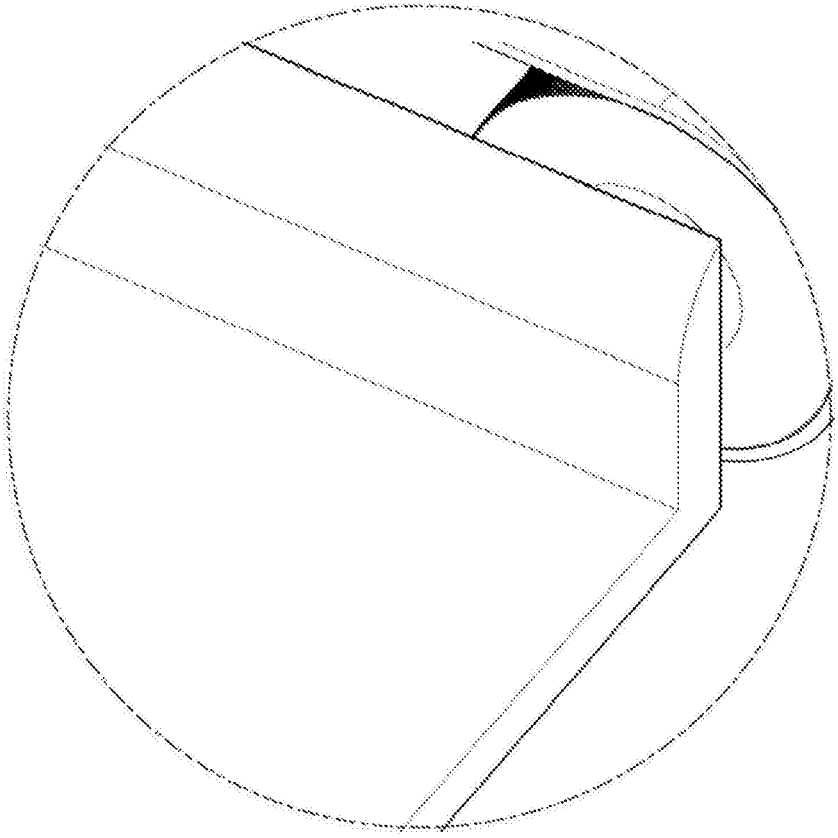
FIG. 5 is a schematic partial enlarged diagram of a chamfer of an automatic expansion/contraction connecting groove mechanism at ③ in FIG. 2.
Figure 6:
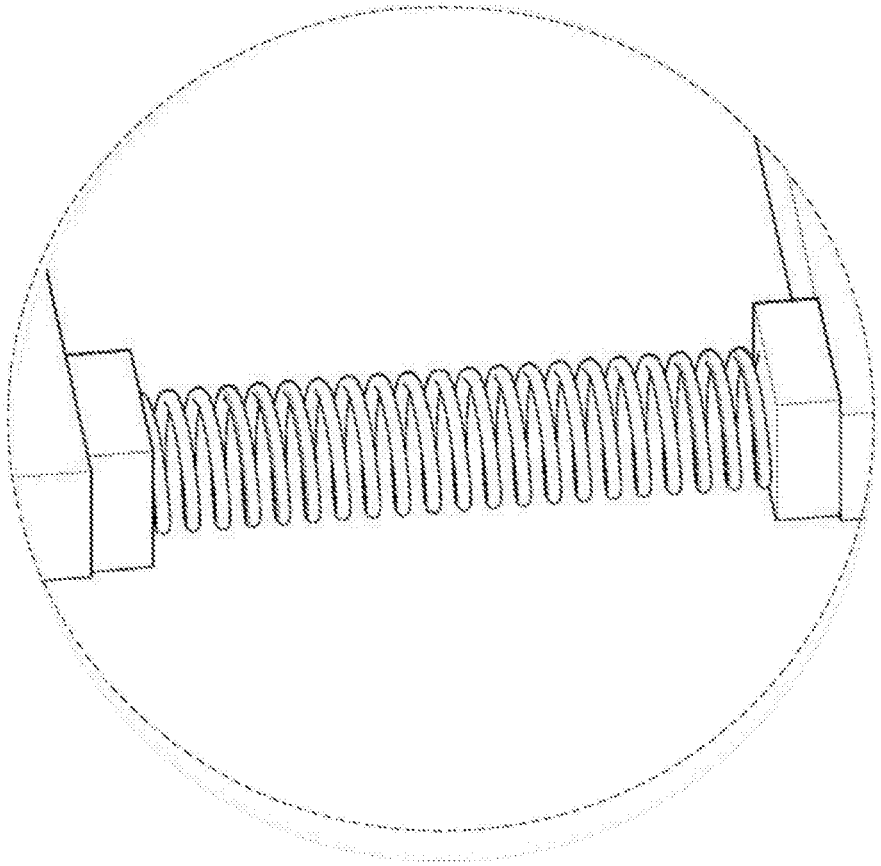
FIG. 6 is a schematic partial enlarged diagram of a telescopic spring of the automatic expansion/contraction connecting groove mechanism at ④ in FIG. 2.
Figure 7:
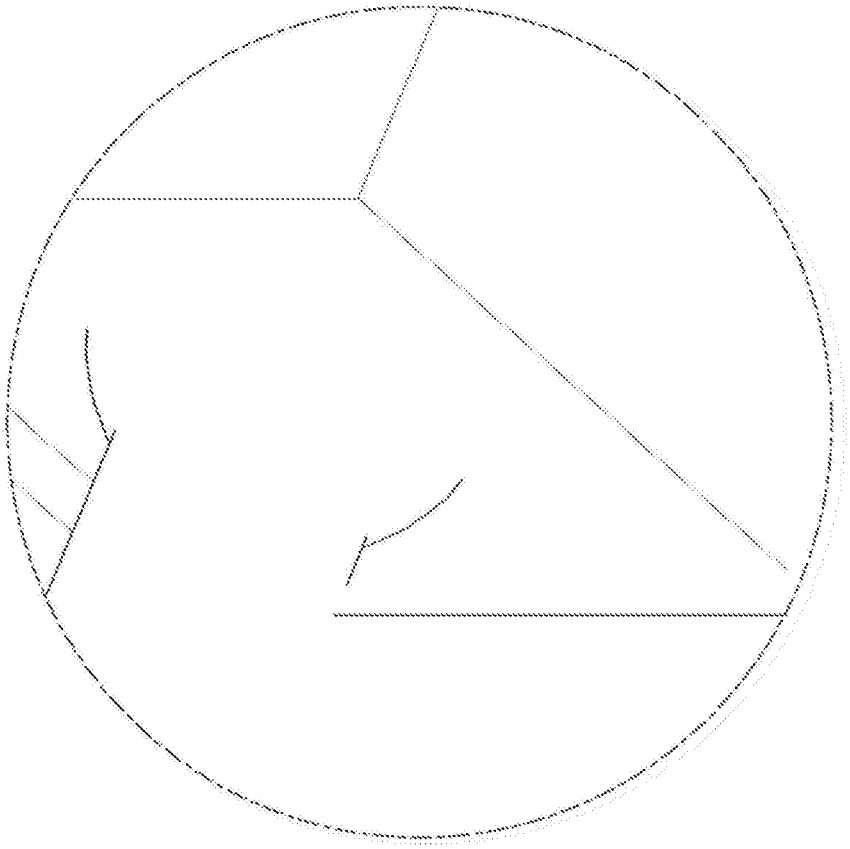
FIG. 7 is a schematic partial enlarged diagram of a spherical hinge mechanism at ⑤ in FIG. 2.

As shown in FIG. 1 to FIG. 7, an apparatus for protecting a roof tray when a gob-side entry retaining end support migrates is mounted at a top end position of a hydraulic support, and includes a movable bearing mechanism, an automatic expansion/contraction connecting groove mechanism, and an active reset mechanism. The movable bearing mechanism includes two parallel equal-length conveying belts 4 and several matched rollers 5 supporting the belts 4, and the rollers 5 are mounted on and supported by a bearing mechanism 10. The automatic expansion/contraction connecting groove mechanism is two concave base plates 8 fixed between the two belts 4, and the two concave base plates 8 are oppositely disposed and spaced by a distance. The active reset mechanism includes two telescopic rods 3 and reset springs 2 sleeved on the telescopic rods 3, the telescopic rod 3 is connected to an end portion of the reset spring 2 to form a synchronous mechanism, and the two both have one end connected to one side of the concave base plate 8 and the other end fixed at the end position of the hydraulic support through a fixed support 1.

After the hydraulic support is lifted, a tray and some anchor cables or anchor rods that are exposed are embedded between the two concave base plates of the groove mechanism to form a gap, and an upper portion of the belt 4 is attached to the roof through a movable bearing mechanism. As the hydraulic support advances, the belt 4 drives, under backward friction of the roof and forward friction of the end support, the roller 5 to rotate, and the movable bearing mechanism drives the groove mechanism to move backwards relative to the hydraulic support at the same time, and stretches the reset spring 2 in the active reset mechanism. When the hydraulic support is relieved and contracts, and a top beam is lowered, friction between the movable bearing mechanism and the roof is eliminated, and the reset spring 2 in the active reset mechanism pulls the movable bearing mechanism and the groove mechanism to return under the action of resilience.

Further, the two concave base plates 8 are connected through several telescopic springs 7, and the telescopic springs 7 are all anchored on the concave base plates 8 on two sides through an anchor member 6.

Because the anchor rods or the anchor cables designed during early-stage reinforced shoring of the roadway are not all arranged according to a uniform standard, the tray and some anchor rob/anchor cable structures that are exposed are misaligned. The springs 7 between the concave base plates 8 can make the tray and some anchor robs/anchor cables that are exposed and that are misaligned accommodated in a protection scope, and a use scope of a protection mechanism is enlarged. Due to addition of the mechanism, the tray and some anchor rob/anchor cable structures that are exposed and that are misaligned can all be included in the protection scope, thereby providing an elastic telescopic buffer range for functioning of the whole apparatus.

To ensure flexibility during expansion of the springs 7 between the concave base plates 8, the telescopic rod 3 is connected in a hinged manner to the fixed support 1 through an end hinge ball 9.

To increase friction between the belt 4 and the roller 5, one surface of the belt 4 in contact with the roller 5 is provided with meshing teeth, and the roller 5 is a meshing roller matching the meshing teeth on the belt 4.

The telescopic rod 3 is a damping telescopic rod, and when being reset, the damping telescopic rod may counteract a forward inertia force of the movable bearing mechanism and the groove mechanism and a contraction force of some springs, so that the apparatus can be reset better.

Further, if an expansion amount of the telescopic spring 7 is defined as k, a length of the telescopic spring 7 in an initial state is a, a width of each concave base plate 8 is b, a width of each belt 4 is c, and a total width of the support is L, $k+a+2b+2c=L$. If a maximum offset between anchor rods or anchor cables of each row is defined as M, $M=k$.

A working principle is as follows:

The mechanism is mounted at the end position of the hydraulic support through the fixed support 1. Then, the tray and some anchor rods/anchor cables that are exposed are embedded into the groove mechanism capable of automatically expanding/contracting for connection. A supporting force of the support is transferred to the roof through the movable bearing mechanism, and an end support moves under pressure in a gate road. As the end support advances, the belt 4 of the movable bearing mechanism drives, under backward friction of the roof and forward friction of the end support, the roller 5 to rotate, and the movable bearing mechanism drives the groove mechanism to move backwards relative to the hydraulic support. At the same time, the reset spring 2 and the damping telescopic rod 3 in the automatic reset mechanism are expanded under a pulling force. When the reset spring of the automatic reset mechanism stretches to a maximum extension length of the spring, the end support is relieved, the top beam is lowered, and the reset spring 2 of the automatic reset mechanism contracts and pulls the movable bearing mechanism and the groove mechanism to move forwards. The damping telescopic rod 3 contracts as the reset spring 2 contracts, and counteracts the forward inertia force of the movable bearing mechanism and the groove mechanism capable of expanding/contracting for connection and the contraction force of some reset springs in time. The apparatus is reset.

What is claimed is:

1. An apparatus for protecting a roof tray when a gob-side entry retaining end support migrates, comprising:

a movable bearing mechanism, an automatic expansion-contraction connecting groove mechanism, and an active reset mechanism;

wherein the apparatus is mounted at a top end position of a hydraulic support; the movable bearing mechanism comprises two conveying belts and a plurality of rollers, wherein the two conveying belts are parallel to each other and are of an equal length; the plurality of rollers are matched with the two conveying belts and support the two conveying belts, and the plurality of rollers are mounted on and supported by a bearing mechanism;

the automatic expansion-contraction connecting groove mechanism is two concave base plates, wherein the two concave base plates are fixed between the two conveying belts, and the two concave base plates are disposed opposite to each other and spaced by a distance; and the active reset mechanism comprises two telescopic rods and reset springs, wherein each reset spring of the reset springs is sleeved on the two telescopic rods, each telescopic rod of the two telescopic rods is connected to an end portion of the reset springs to form a synchronous mechanism, and a first end of the each telescopic rod and a first end of the each reset spring are connected to one side of the two concave base plates and a second end of the each telescopic rod and a second end of the each reset spring are fixed at the top end position of the hydraulic support through a fixed support.

2. The apparatus for protecting the roof tray when the gob-side entry retaining end support migrates according to claim 1, wherein, the two concave base plates are connected through a plurality of telescopic springs, and the plurality of telescopic springs are anchored on the concave two base plates on two sides of the plurality of telescopic springs through an anchor member.

3. The apparatus for protecting the roof tray when the gob-side entry retaining end support migrates according to claim 2, wherein, the each telescopic rod is connected to the fixed support through an end hinge ball in a hinged manner.

4. The apparatus for protecting the roof tray when the gob-side entry retaining end support migrates according to claim 3, wherein, a surface of each conveying belt of the two conveying belts is provided with meshing teeth, wherein the surface of the each conveying belt is in contact with the plurality of rollers, and each of the plurality of rollers is a meshing roller matching the meshing teeth on the each conveying belt.

5. The apparatus for protecting the roof tray when the gob-side entry retaining end support migrates according to claim 4, wherein, the each telescopic rod is a damping telescopic rod.

6. The apparatus for protecting the roof tray when the gob-side entry retaining end support migrates according to claim 5, wherein, an expansion amount of a telescopic spring of the plurality of telescopic springs is defined as k, a length of the telescopic spring in an initial state is defined as a, a width of each of the two concave base plates is defined as b, a width of each of the two conveying belt is defined as c, a total width of the gob-side entry retaining end support is defined as L, and k+a+2b+2c=L; and a maximum offset between anchor rods or anchor cables of each row is defined as M, and M=k.

7. The apparatus for protecting the roof tray when the gob-side entry retaining end support migrates according to claim 3, wherein, the each telescopic rod is a damping telescopic rod.

8. The apparatus for protecting the roof tray when the gob-side entry retaining end support migrates according to claim 7, wherein, an expansion amount of a telescopic spring of the plurality of telescopic springs is defined as k, a length of the telescopic spring in an initial state is defined as a, a width of each of the two concave base plates is defined as b, a width of each of the two conveying belt is defined as c, a total width of the gob-side entry retaining end support is defined as L, and k+a+2b+2c=L; and a maximum offset between anchor rods or anchor cables of each row is defined as M, and M=k.

9. The apparatus for protecting the roof tray when the gob-side entry retaining end support migrates according to claim 2, wherein, the each telescopic rod is a damping telescopic rod.

10. The apparatus for protecting the roof tray when the gob-side entry retaining end support migrates according to claim 9, wherein, an expansion amount of a telescopic spring of the plurality of telescopic springs is defined as k, a length of the telescopic spring in an initial state is defined as a, a width of each of the two concave base plates is defined as b, a width of each of the two conveying belt is defined as c, a total width of the gob-side entry retaining end support is defined as L, and k+a+2b+2c=L; and a maximum offset between anchor rods or anchor cables of each row is defined as M, and M=k.

11. The apparatus for protecting the roof tray when the gob-side entry retaining end support migrates according to claim 1, wherein, the each telescopic rod is a damping telescopic rod.

12. The apparatus for protecting the roof tray when the gob-side entry retaining end support migrates according to claim 11, wherein, an expansion amount of a telescopic spring is defined as k, a length of the telescopic spring in an initial state is defined as a, a width of each of the two concave base plates is defined as b, a width of each of the two conveying belt is defined as c, a total width of the gob-side entry retaining end support is defined as L, and k+a+2b+2c=L; and a maximum offset between anchor rods or anchor cables of each row is defined as M, and M=k.

* * * * *